US008671873B2

(12) United States Patent
Danielson

(10) Patent No.: US 8,671,873 B2
(45) Date of Patent: Mar. 18, 2014

(54) PAINTING DEVICE TO PRODUCE DECORATIVE APPEARANCE

(75) Inventor: Lee M. Danielson, Cosmos, MN (US)

(73) Assignee: Lee M. Danielson, Cosmos, MN (US)

( * ) Notice: Subject to any disclaimer, the term of this patent is extended or adjusted under 35 U.S.C. 154(b) by 1105 days.

(21) Appl. No.: 11/601,250

(22) Filed: Nov. 18, 2006

(65) Prior Publication Data

US 2008/0118632 A1 May 22, 2008

(51) Int. Cl.
*B05C 17/12* (2006.01)

(52) U.S. Cl.
USPC ..... 118/264; 118/265

(58) Field of Classification Search
USPC ..... 118/264, 265; 15/209.1, 244.1, 210.1, 15/210.5; 427/429; 101/379; 434/84; 33/27.03
See application file for complete search history.

(56) References Cited

U.S. PATENT DOCUMENTS

| | | | | | |
|---|---|---|---|---|---|
| 1,449,856 | A * | 3/1923 | Hampson | 427/274 |
| 3,817,178 | A * | 6/1974 | Hagen | 101/379 |
| 5,505,130 | A * | 4/1996 | Winston | 101/333 |
| D402,474 | S * | 12/1998 | Danielson | D4/137 |
| 2002/0121205 | A1 * | 9/2002 | Peterson | 101/405 |

* cited by examiner

*Primary Examiner* — Laura Edwards

(57) ABSTRACT

A painting device is disclosed that is simple and easy to use to produce a faux brick appearance on domestic and commercial walls. The painting device has a base plate with a handle. An absorbent layer is attached to the base plate to absorb and hold paint that is to be applied to a wall. The painting device preferably also has vertical and horizontal spacing guides and a leveling device. The base plate and absorbent layer are preferably formed in the shape of the cross-section of a brick but may be formed in many shapes. The painting device is able to produce exacting, ordered results. In addition, there is no need for the operator to be highly skilled. The invention is used in combination with a paint tray and multiple colors of paint to produce an end result of an ordered brick appearance.

9 Claims, 4 Drawing Sheets

PAINTING DEVICE TO PRODUCE DECORATIVE APPEARANCE

BACKGROUND OF THE INVENTION

1. Field of the Invention

The present invention relates generally to a device for painting walls with a decorative pattern.

2. Description of Related Art

Recently there has been an increased popularity in decorating walls with more than one colors. While printed wall paper has been one solution to applying more than one color to walls, including applying more complex designs to walls, it is often expensive and needs a relatively high level of skill to apply. The application of two or more colors to walls is generally done by painting techniques imploying brushes, rollers and rags. These methods produce a random chaotic application of color. While this is often pleasing to the eye, a more ordered appearance is also appealing.

Devices to apply ordered color schemes to walls by paint are known such as shown in U.S. Pat. No. D402,474 entitled "Brick printing apparatus" issued to Lee Danielson on Dec. 15, 1998; U.S. Pat. No. 1,449,856 entitled "Method of Stippling Surfaces" issued to C. G. Hampson on Mar. 27, 1923; U.S. Pat. No. 3,817,178 entitled "Apparatus for Ornamenting Walls and Ceilings" issued to Dean C. Hagen on Jun. 18, 1974. These devices, as well as stencils, are often cumbersome and not exacting in use. A high level of operator skill is usually required to produce uniform results.

From the above, it can be seen what is needed is a painting device that is easy to use to produce a faux brick appearance on domestic and commercial walls to enhance the warmth and appearance of the wall.

SUMMARY OF THE INVENTION

The present invention is a painting device that is simple and easy to use to produce a faux brick appearance on domestic and commercial walls. The painting device has a base plate with a handle. An absorbent layer is attached to the base plate to absorb and hold paint that is to be applied to a wall. The base plate and absorbent layer are preferably formed in the shape of the cross-section of a brick (i.e., a 2 dimensional form of a brick) but may be formed in many shapes. The painting device is able to produce exacting, ordered results. In addition, there is no need for the operator to be highly skilled.

The improved painting device to produce a faux brick appearance, according to the present invention also has vertical and horizontal spacing guides and a leveling device. The invention is used in combination with a paint tray and multiple colors of paint to produce an end result of an ordered brick appearance.

The method employed is comprised of painting the back ground wall with a first color of paint. Then the desired shape is painted on the wall by loading the absorbent layer with the desired paint and then applying the paint to the wall in a horizontal fashion, row by row. Texture and alternate color effects come from dripping small amounts of texture or color into the paint tray of the paint that is to be applied by the painting device.

It is therefore an object of one embodiment of the invention to provide a device that creates a faux-brick appearance on a wall.

It is therefore an object of one embodiment of the invention to provide a device that simply and easily creates a decorative patterns in paint on a wall.

It is therefore an object of one embodiment of the invention to provide a device that creates decorative patterns in paint on a wall in a horizontal or vertical pattern.

It is therefore an object of one embodiment of the invention to provide a device that creates a faux-brick appearance on a wall where the individual bricks are spaced from each other by amounts equivilant to the spacing of "real" bricks on a wall.

Not all of these objects need be present in a single embodiment. Instead, a particular embodiment may have one or more of these objects. These and other objects of the invention will be clear from the following detailed description of the invention in connection with the drawings.

BRIEF DESCRIPTION OF THE DRAWINGS

The invention will be described hereafter in detail with particular reference to the drawings. Throughout this description, like elements, in whatever embodiment described, refer to common elements wherever referred to and referenced by the same reference number. The characteristics, attributes, functions, interrelations ascribed to a particular element in one location apply to that element when referred to by the same reference number in another location unless specifically stated otherwise. In addition, the exact dimensions and dimensional proportions to conform to specific force, weight, strength and similar requirements will be within the skill of the art after the following description has been read and understood. Furthermore, when the terms "top", "bottom", "side" and similar terms are used herein, it should be understood that these terms have reference only to the structure shown in the drawings as it would appear to a person viewing the drawings and are utilized only to facilitate describing the embodiments.

All Figures are drawn for ease of explanation of the basic teachings of the present invention only; the extensions of the Figures with respect to number, position, relationship, and dimensions of the parts to form examples of the various embodiments will be explained or will be within the skill of the art after the following description has been read and understood. Further, the exact dimensions and dimensional proportions to conform to specific force, weight, strength and similar requirements will likewise be within the skill of the art after the following description has been read and understood.

DETAILED DESCRIPTION OF THE INVENTION

Figure 1:
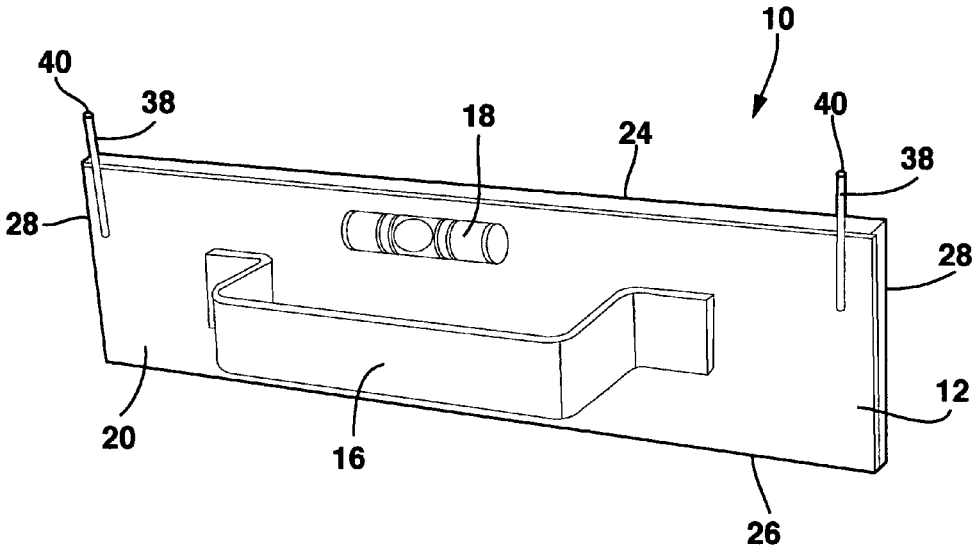
FIG. 1 is a perspective view of one embodiment of the faux brick painting device of the present invention.
Figure 2:
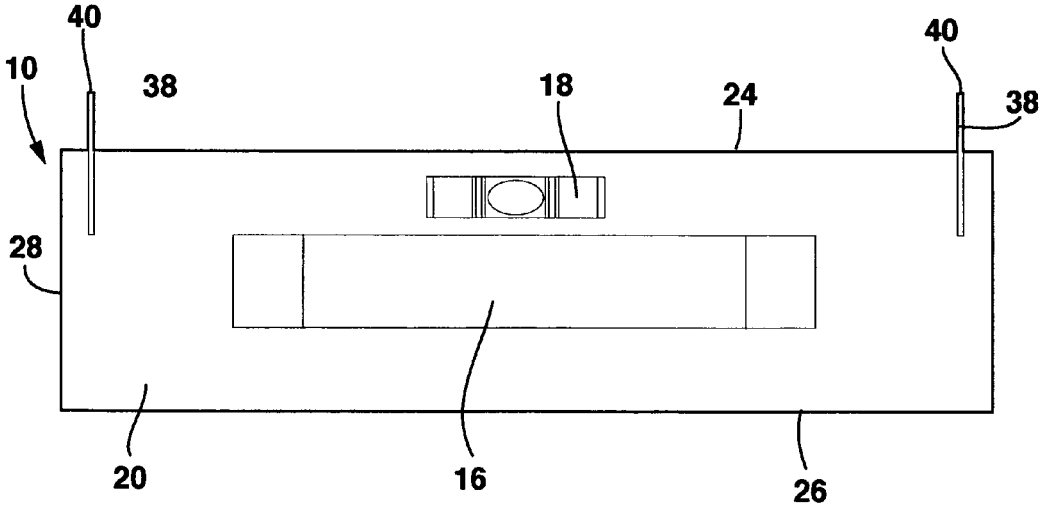
FIG. 2 is a plan view of the painting device of FIG. 1.

In order that the invention may be clearly understood and readily carried into effect, preferred embodiments of the invention will now be described, by way of example only and not to limit the invention, with reference to the accompanying drawings. The painting device of the present invention is shown in the drawings generally labeled 10. The painting device 10 includes a base plate 12, an absorbent layer 14 attached to the base plate 12 and a handle 16 attached to the base plate 12. In the preferred embodiment of the invention, the painting device 10 includes a level 18.

Figure 3:
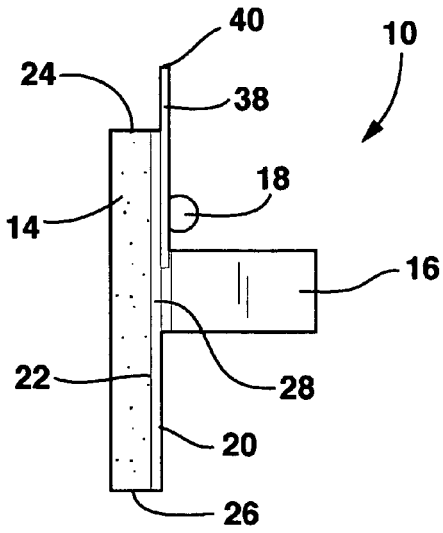
FIG. 3 is a side view of the painting device of FIG. 1.

The base plate 12 is preferably relatively thin and planar and dimensioned or made of a material to be rigid. (FIG. 3) The base plate 12, in its preferred embodiment, has a front 20, a back 22, a top 24, bottom 26 and opposed sides 28. In the preferred embodiment of the painting device 10, the base plate 12 is rectangular. As a result, the corners of the base plate 12 in preferred embodiment will be right angles.

Although the base plate 12 has been described in its preferred embodiment is being rectangular in shape, base plate 12 may take any number of shapes, examples of which will be described hereafter, but which also include known geometric shapes, with or without opposed sides 28 and whether having parallel or even straight sides or not. The function of the base plate 12 is to define the shape of the absorbent layer 14 and consequently the pattern 30 of paint applied by the painting device 10 as will be described in detail hereafter.

The absorbent layer 14 is attached to and covers substantially all of the back 22. The absorbent layer 14 is attached to back 22 by means including, but not limited to, adhesives, clamping, mechanical connection or hook and loop fasteners. As a result, the absorbent layer 14 may be either permanently or removably attached to the base plate 12. The function of the absorbent layer 14 is to absorb paint 32, for example from a paint tray 34, and transport the paint 32 to a wall 36 where the paint 32 can be deposited on the wall 36. Consequently, the absorbent layer 14 should have dimensions, particularly a thickness, and absorbent characteristics sufficient to absorb a desired amount of paint 32 without having the paint 32 drain from the absorbent layer 14 before the paint 32 can be applied to the wall 36. Examples of absorbent layer 14 include, but are not limited to, artificial or natural sponge, cloth, leather, batting or fur.

A handle 16 is attached to the front 20 of the base plate 12. The function of the handle 16 is to allow the user to manipulate the base plate 12 and absorbent layer 14 so that paint 32 may be applied to the absorbent layer 14 and then applied to particular desired locations on a wall 36 as will be described hereafter. Handle 16 may take any form including, but not limited to, a handle allowing the user to place his or her fingers between a portion of the handle 16 and the base plate 12 whereby the user grasps a portion of the handle 16 (FIG. 1), a handle connected at one end to the base plate 12 and one or more knobs.

As mentioned above, the painting device 10 includes a level 18. The function of the level 18 is to indicate to the user when the painting device 10 has a particular orientation. In the preferred embodiment of the invention, the level 18 indicates when the base plate 12 has a horizontal orientation. As a result, level 18 is preferably attached to the front of the base plate 12 near the top of the base plate 12 and equally spaced between the opposed sides 28. However, level 18 may also be located anywhere on the base plate 12 or attached to the top 24, bottom 26 or opposed sides 28.

In addition, the level 18 may be oriented to indicate when the base plate 12 has a vertical orientation. This is done by placing the level 18 in a substantially vertical orientation. In a further alternate embodiment, the painting device 10 may include two levels 18, one level 18 indicating when the painting device 10 has a horizontal orientation and the other level 18 indicating when the painting device 10 has a vertical orientation. In the preferred embodiment, level 18 is a bubble level such as is commonly used in carpenter levels or similar devices.

Also in the preferred embodiment of the painting device 10, the painting device 10 includes a pair of vertically directed spacing indicator bars 38 having ultimate ends 40. Preferably, these spacing indicator bars 38 extend upward from the top 24 of the base plate 12. The function of the spacing indicator bars 38 is to assist the user in creating the proper vertical spacing between the individual patterns 42 formed by each individual use of the painting device 10 (FIG. 6) as will be explained in detail hereafter.

Figure 6:
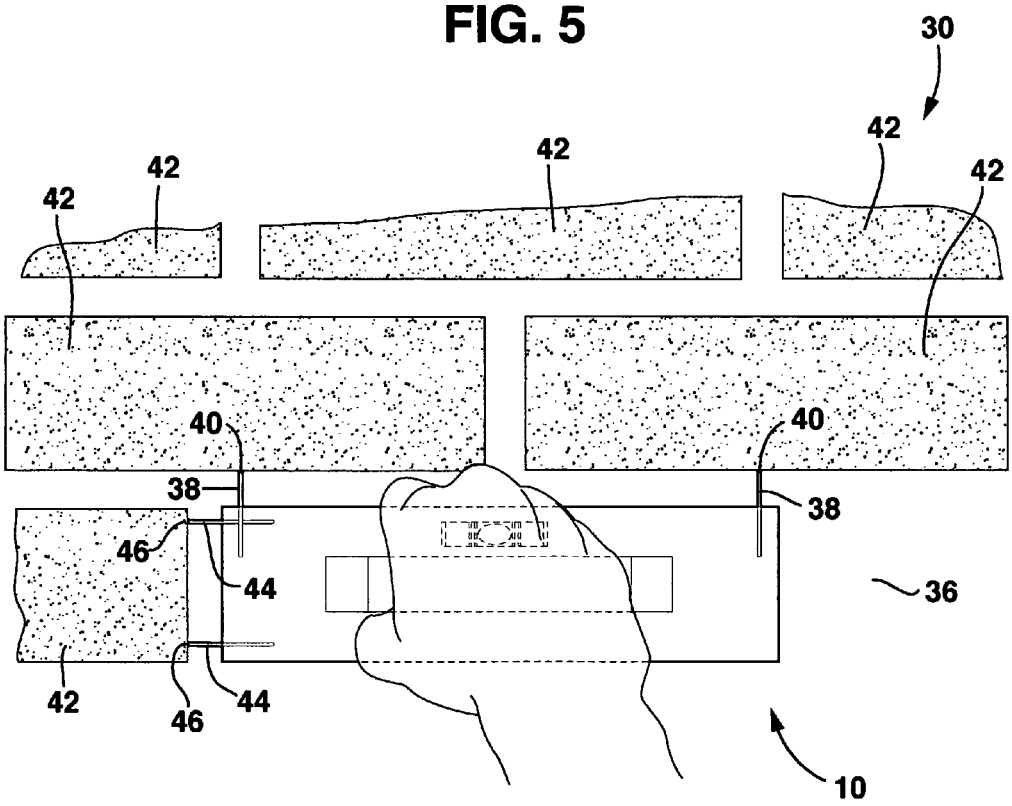
FIG. 6 is plan view of step three of the method of using the device of FIG. 1 to paint a wall.

Alternately, or in addition, the painting device 10 may also include at least a pair of horizontally directed spacing indicator bars 44 having ultimate ends 46 (FIG. 6). In embodiments of the painting device 10 that include these horizontally directed spacing indicator bars 44, the horizontally directed spacing indicator bars 44 aid the user in creating the proper horizontal spacing between the individual patterns 42 formed by each individual use of the painting device 10. Although the preferred embodiment of both the vertically directed spacing indicator bars 38 and the horizontally directed spacing indicator bars 44 include at least two of each such bars, 38, 44, a single bar 38, 44 or more than two bars 38, 44 may also be used. In one embodiment of the present painting device 10, at least one horizontally directed spacing indicator bar 44 and at least one vertically directed spacing indicator bar 38 are perpendicular and overlap on at least one corner of the painting device 10.

Figure 7:
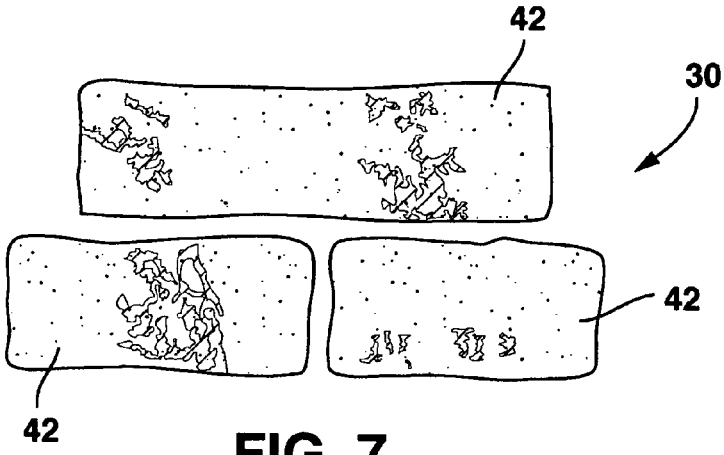
FIG. 7 is a plan view of a portion of the wall that has been painted according to the method of using the device of FIG. 1 to paint the wall.

In the preferred embodiment of the painting device 10, the base plate 12 and absorbent layer 14 are sized and dimensioned to have the approximate size and shape of the peripheral dimensions of a brick on the face of a wall 36. As a result, as will be described hereafter, the painting device 10 will produce a pattern 30 on the wall 36 having the appearance of or suggesting that the wall 36 is made of brick. (FIG. 7)

Figure 8:
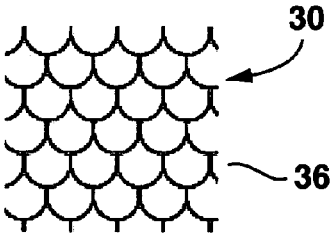
FIG. 8 is a plan view of a portion of the wall that has been painted according to the method of using an alternate embodiment of the device of FIG. 1 to paint the wall.
Figure 9:
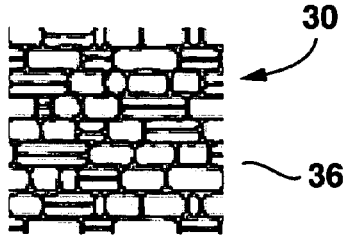
FIG. 9 is a plan view of a portion of the wall that has been painted according to the method of using an alternate embodiment of the device of FIG. 1 to paint the wall.
Figure 10:
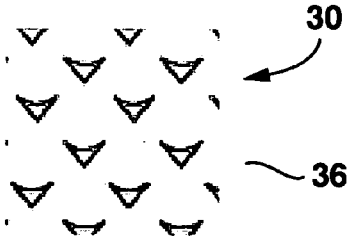
FIG. 10 is a plan view of a portion of the wall that has been painted according to the method of using an alternate embodiment of the device of FIG. 1 to paint the wall.
Figure 11:
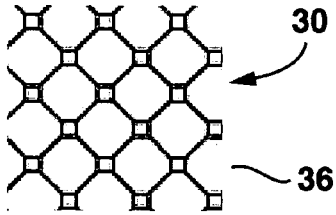
FIG. 11 is a plan view of a portion of the wall that has been painted according to the method of using an alternate embodiment of the device of FIG. 1 to paint the wall.
Figure 12:
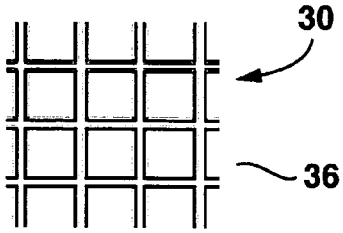
FIG. 12 is a plan view of a portion of the wall that has been painted according to the method of using an alternate embodiment of the device of FIG. 1 to paint the wall.
Figure 13:
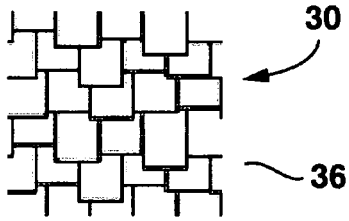
FIG. 13 is a plan view of a portion of the wall that has been painted according to the method of using an alternate embodiment of the device of FIG. 1 to paint the wall.

Although the preferred embodiment of the painting device 10 has the base plate 12 and absorbent layer 14 sized and dimensioned to approximate the peripheral dimensions of a brick on the face of a wall 36, other patterns for the size and shape of the base plate 12 and absorbent layer 14 are also within the scope of the invention. For example, the base plate 12 and absorbent layer 14 may take the form of one or more fish scales so that by appropriate location of the painting device 10 on a wall 36 as will be described hereafter, a pattern 30 of overlapping scales is presented. (FIG. 8)

Other exemplary forms of the base plate 12 and absorbent layer 14 are shown in FIGS. 9 through 13 where patterns 30 of or suggesting rock, chevrons and squares in a lattice form or overlapping form are shown, respectively. The forms of the base plate 12 and absorbent layer 14 shown in FIGS. 7 through 13 are exemplary and not intended to be limiting. It is clear that an almost infinite variety of forms and shapes for base plate 12 absorbent layer 14 will occur to those skilled in the art and are intended to fall within the scope of the invention.

Figure 4:
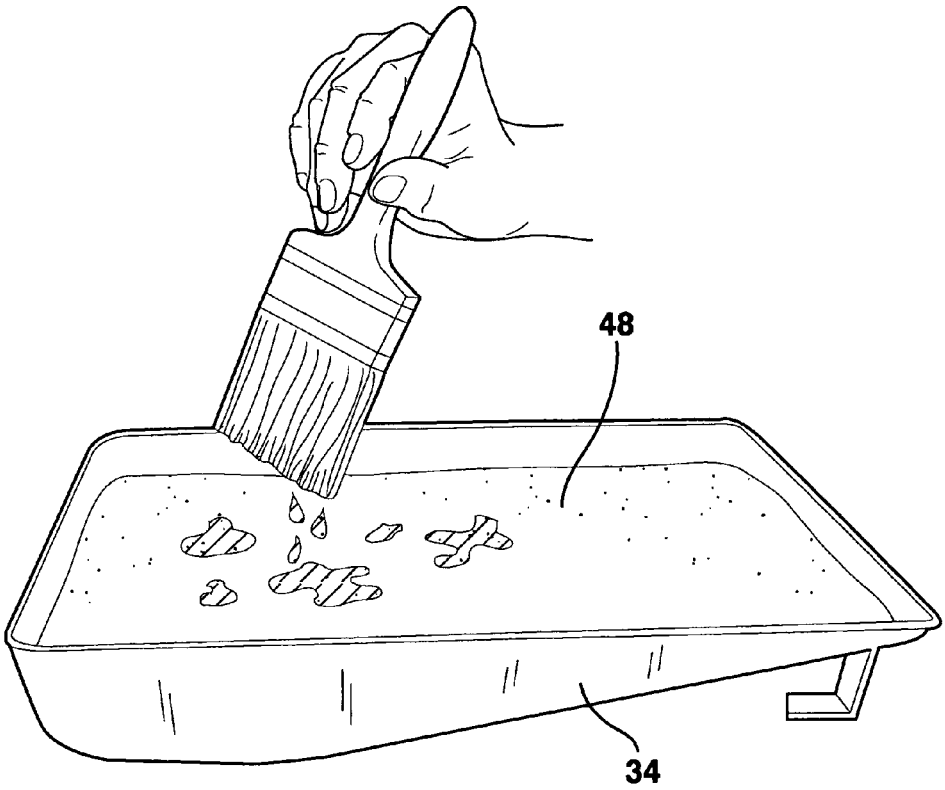
FIG. 4 is a perspective view of step one of the method of using the device of FIG. 1 to paint a wall.

The method of using the painting device 10 of the present invention will now be described. The first step, shown in FIG. 4, is to paint the wall 36 with a base color of paint 48. Any standard method of applying paint to a wall 36, as well understood in the art, may be used.

Figure 5:
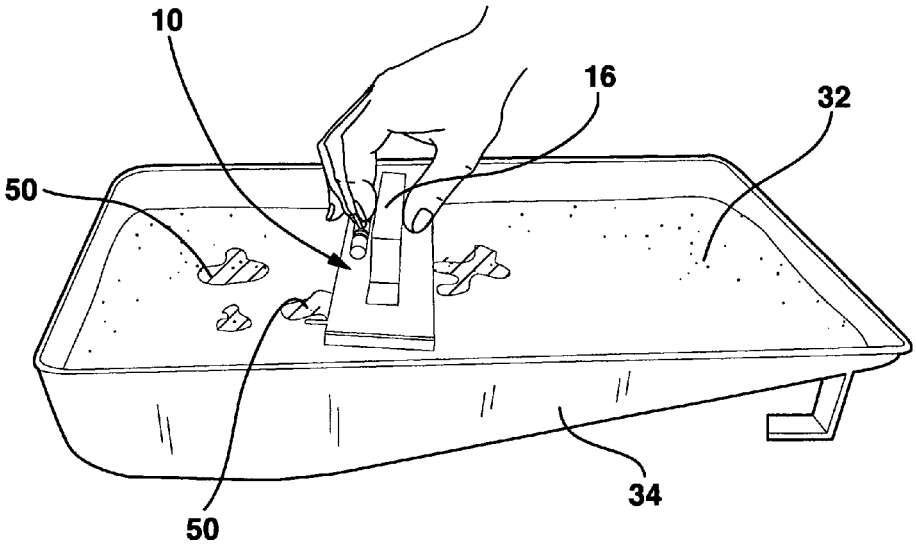
FIG. 5 is a perspective view of step two of the method of using the device of FIG. 1 to paint a wall.

The next step, shown in FIG. 5, is taking the painting device 10 and moving the absorbent layer 14 into contact with paint 32 in the paint tray 34 having a different color than the paint 48 that was originally applied to the wall 36. In order to minimize the mess of having paint 32 contact the front 20 of the base plate 12, handle 16 or level 18, the user should dip only the absorbent layer 14 in the paint 32.

Thereafter, the painting device 10 with the paint 32 held on and within the absorbent layer 14 is moved to the wall 36 where the absorbent layer 14 is pressed into contact with the wall 36 thereby transferring paint 32 from the absorbent layer of 14 to the wall 36. (FIG. 6) The level 18 aids the user in horizontally aligning the base plate 12, and consequently the absorbent layer 14, on the wall 36 so that the resulting individual pattern 42 on the wall 36 will also be horizontally aligned. Alternately, where the level 18 is vertically aligned, the level 18 aids the user in vertically aligning the base plate 12, and consequently the absorbent layer 14, on the wall 36 so that the resulting individual pattern 42 on the wall 36 will also be vertically aligned.

The vertically directed spacing indicator bars 38 have a height sufficient that when the user places their ultimate ends 40 at the bottom of the brick individual pattern 42 immediately above the location where the user desires to place a new brick individual pattern 42, the new brick individual pattern 42 will be spaced below the brick individual pattern 42 immediately above a distance corresponding to the distance that a "real" brick would be spaced from the other "real" bricks above by a distance approximating the thickness of mortar between the two brick layers. In the example just given, the brick pattern 30 was started by placing brick individual patterns 42 horizontally in a row. Thereafter, brick individual patterns 42 were moved downward from the original row of brick individual patterns 42 and placed one at a time in a horizontal direction.

However, the user may apply a horizontal pattern of brick individual patterns 42 and then move upward by turning the painting device 10 so that the vertically directed spacing indicator bars 38 point downward instead of upward as shown in FIG. 6.

Further, where horizontally directed space indicator bars 44 are used, the brick individual pattern 42 to be applied to the wall 36 may be spaced from another previously applied brick individual pattern 42 by a distance corresponding to the thickness of a layer of mortar that typically separates "real" bricks in a side by side arrangement. In using horizontally directed spacing indicator bars 44, the ultimate ends 46 of the spacing indicator bars 44 are placed up to but not touching the vertical edge of the existing brick individual pattern 42. As a result, the currently applied brick individual pattern 42 will have the desired spacing, approximating the thickness of a layer of mortar, from the existing brick individual pattern 42.

In a variant of the method described above, texture and alternate colors may be applied to the pattern color paint 32 by tripping small amounts of paint or texture 50 into the paint 32 in the paint tray 34 prior to dipping the absorbent layer 14 in the paint as described above.

The scope of the invention should be determined not by the embodiments illustrated, but by the appended claims and their legal equivalents. The description contained herein is intended to be illustrative and not exhaustive. Many variations and alternatives of the described technique and method will occur to one of ordinary skill in this art. Variations in form to the component pieces described and shown in the drawings may be made as will occur to those skilled in the art. Further, although certain embodiments of a painting device 10 have been described, it is also within the scope of the invention to add other additional components such as a laser leveling device or gyroscopes to aid in orienting the painting device 10 or to remove one or more of certain components such as the level 18, vertically directed spacing bars 38 or horizontally directed spacing bars 44. All these alternatives and variations are intended to be included within the scope of the attached claims. Those familiar with the art may recognize other equivalents to the specific embodiments described herein which equivalents are also intended to be encompassed by the claims attached hereto. As a result, while the above description contains may specificities, these should not be construed as limitations on the scope of the invention but rather as examples of different embodiments thereof. Accordingly, the scope of the invention should be determined not by the embodiments illustrated but by the appended claims and their legal equivalents.

I claim:

1. A painting device for creating a decorative pattern on a wall comprising:

a base plate having a front and a back;

an absorbent layer attached to the base plate;

a handle attached to the base plate;

a level attached to the base plate;

at least one horizontally aligned spacing indicator bar attached to and extending away from the base plate in a horizontal direction;

at least one vertically aligned spacing indicator bar attached to and extending away from the base plate in a vertical direction;

the at least one horizontally aligned spacing indicator bar and the at least one vertically aligned spacing indicator bar being perpendicular and overlapping on at least one corner of the base plate;

wherein the base plate and absorbent layer are sized and dimensioned to have the approximate size and shape of the peripheral dimensions of a brick on the face of a wall whereby the painting device will produce a pattern on the wall having the appearance of or suggesting that the wall is made of brick.

2. The painting device of claim 1 wherein the vertically aligned spacing indicator bar has a length corresponding to a desired spacing of the painting device from a point on a wall.

3. The painting device of claim 1 wherein the horizontally aligned spacing indicator bar has a length corresponding to a desired spacing of the painting device from a point on a wall.

4. The painting device of claim 1 wherein the level is oriented to indicate when the base plate has a horizontal orientation.

5. The painting device of claim 1 wherein the level is oriented to indicate when the base plate has a vertical orientation.

6. The painting device of claim 1 wherein the level is oriented to indicate when the base plate has a horizontal orientation and further comprising a second level oriented to indicate when the base plate has a vertical orientation.

7. The painting device of claim 1 wherein the level is a bubble level.

8. The painting device of claim 1 wherein the absorbent layer is permanently attached to the base plate.

9. The painting device of claim 1 wherein the absorbent layer is removably attached to the base plate.

* * * * *